US006454388B1

(12) United States Patent
Bretl et al.

(10) Patent No.: US 6,454,388 B1
(45) Date of Patent: Sep. 24, 2002

(54) SEQUESTERING RESIDUAL INK ON AN INK-JET PRINT CARTRIDGE

(75) Inventors: Frank J. Bretl, Corvallis, OR (US); Roy Glenn Atkinson, Kildare (IE); Emmet Whittaker, Dublin (IE); Melissa D. Lee, Escondido, CA (US); Jason H. Oakes, Corvallis, OR (US); Paul Killeen, Kildare (IE); Mark D. Zinser, Camas, WA (US); Melanie J Feder, Blodgett, OR (US); Richard J. McManus, San Diego, CA (US); Ralph L. Stathem, Lebanon, OR (US); Kevin Almen, Albany, OR (US); Warren S. Martin, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/473,626

(22) Filed: Dec. 29, 1999

(51) Int. Cl.[7] ..... B41J 2/165
(52) U.S. Cl. ..... 347/36; 347/33; 347/86
(58) Field of Search ..... 347/36, 28, 31, 347/33, 102, 45, 44, 49, 86, 85

(56) References Cited

U.S. PATENT DOCUMENTS

| | | | | | |
|---|---|---|---|---|---|
| 4,890,126 | A | * | 12/1989 | Hotomi | 347/45 |
| 5,091,087 | A | * | 2/1992 | Calundann et al. | 210/500.28 |
| 5,155,497 | A | | 10/1992 | Martin | 347/29 |
| 5,300,958 | A | | 4/1994 | Burke et al. | 347/29 |
| 5,517,221 | A | | 5/1996 | Nguyen | 347/31 |
| 5,560,980 | A | | 10/1996 | Sakaki | 428/195 |
| 5,579,038 | A | | 11/1996 | Kimura | 347/36 |
| 5,583,548 | A | | 12/1996 | Kearns | 347/33 |
| 5,589,865 | A | | 12/1996 | Beeson | 347/28 |
| 5,682,186 | A | | 10/1997 | Bohorquez et al. | 347/29 |
| 5,754,197 | A | | 5/1998 | Shibata | 347/22 |
| 5,798,775 | A | * | 8/1998 | Takahashi et al. | 347/33 |
| 5,812,157 | A | | 9/1998 | Nguyen | 347/32 |
| 5,886,714 | A | | 3/1999 | Burney et al. | 347/33 |
| 5,896,143 | A | * | 4/1999 | Matsui et al. | 347/24 |
| 5,907,335 | A | * | 5/1999 | Johnson et al. | 347/28 |
| 5,949,454 | A | * | 9/1999 | Nozawa et al. | 347/45 |
| 5,971,533 | A | * | 10/1999 | Kinoshita et al. | 347/86 |
| 6,312,105 | B1 | * | 11/2001 | Miyauchi | 347/49 |

FOREIGN PATENT DOCUMENTS

| | | | | |
|---|---|---|---|---|
| EP | 0578330 | B | 9/1990 | |
| EP | 0494693 | A1 | 7/1992 | B41J/2/165 |
| EP | 0597674 | B | 11/1993 | |
| EP | 0769380 | A2 | 4/1997 | B41J/2/165 |
| EP | 0953448 | A1 | 11/1999 | B41J/2/165 |
| JP | 03240554 | A | 10/1991 | B41J/2/18 |
| JP | 07205438 | A | 8/1995 | B41J/2/165 |
| JP | 09141886 | | 11/1995 | |
| JP | 10138515 | | 11/1996 | |
| JP | 10250099 | | 3/1997 | |

OTHER PUBLICATIONS

European Search Report EP 0031 1046, Mar. 15, 2001, De Groot, R.

Jackson et al, DeskJet Printer Chassis and Mechanism Design, Hewlett–Packard Journal, Oct., 1988 pp. 67–75.

Dangelo et al, PrintCartridge Fixturing and Maintenance in the DesckJet 1200C Printer, Hewlett–Packard Journal, Feb. 1994, pp. 67–71.

* cited by examiner

*Primary Examiner*—John Barlow
*Assistant Examiner*—Shih-wen Hsieh

(57) ABSTRACT

A technique for handling residual ink that is from time to time present on the orifice plate of an ink-jet print cartridge. In one preferred embodiment, an ink-jet print cartridge is equipped with an ink-receptive member, such as an absorbent pad. The pad is located so that a service station wiper will move the residual ink from the orifice plate and spread it across the pad. The pad absorbs the ink. In essence, the ink is sequestered on the cartridge, in the pad. The exterior surface of the pad dries quickly so that there is little likelihood of developing a tacky area over the pad to which fibers may stick and degrade print quality.

14 Claims, 2 Drawing Sheets

SEQUESTERING RESIDUAL INK ON AN INK-JET PRINT CARTRIDGE

TECHNICAL FIELD

This invention relates to ink-jet print cartridges, and particularly to handling of residual ink that is present from time to time on the exterior of the cartridge.

BACKGROUND AND SUMMARY OF THE INVENTION

An ink-jet printer includes one or more print cartridges that contain liquid ink in a reservoir. The reservoir is connected to a print head that is mounted to the body of the cartridge. The print head has tiny orifices that enable ejection of minute droplets of ink from the print head to a print medium, such as paper, that is advanced through the printer.

Many ink-jet printers include carriages for holding the print cartridge(s). The carriages translate across the width of the paper as the cartridge ejects ink droplets to the paper. Each time the carriage crosses the paper, a swath or effective print zone can be covered with ink as needed to print an image or text. Between carriage translations, the paper is advanced so that the next swath of the image may be printed.

Oftentimes, especially for color images, the carriage is translated more than once across the same print zone. With each such translation, a different combination of colors or droplet arrangements may be printed until the complete image is formed. Thus, a carriage and the cartridge it carries often move very close to wet or partially dry ink that was applied during an earlier translation.

The ink droplets are expelled through orifices that are formed in an orifice plate that covers most of the print head. Not all of the expelled ink is deposited upon the print medium, however. A small quantity of ink remains on the print head in puddles in the area near the orifices. This residual or waste ink needs to be removed so that it does not collect to an extent that it would interfere with the trajectory of subsequent droplets that are expelled through the orifices. Such interference will degrade the quality of the printed image because subsequent droplets will not be placed on the print medium as intended.

Even if residual ink does not interfere with the trajectory of subsequently expelled ink droplets, its presence may create other problems. For instance, partially dry ink on the cartridge body becomes tacky or sticky. In some printing environments, the tacky ink may collect small paper fibers or similar contaminants present in the printer. Even before the residual ink becomes tacky, its surface tension will retain particles such as these fibers. Furthermore, partially dry ink can clog the orifices on the print head, which will cause poor print quality.

Fibers that stick to the tacky ink can extend therefrom into contact with the print media. In instances where these extending fibers contact ink on the paper (as is most likely to occur during the multi-scan print mode mentioned above) the carriage movement drags the fiber across the wet ink and produces undesirable streaking of the ink.

Irrespective of whether ink streaking occurs, it is desirable to prevent the spread of residual ink to cartridge or printer components that may, over time, be degraded by the corrosive nature of certain ink formulations.

Current versions of ink-jet printers often include mechanisms for periodic servicing of the cartridges. These mechanisms are often referred to as service stations. The carriage occasionally moves away from the print media and into engagement with the service station. One of the functions of the service station is to wipe away the residual ink from the orifice plate of the cartridge, to avoid print quality problems, such as orifice clogging.

In the past, the residual ink that is wiped from the orifice plate has been deposited in storage trenches formed in the smooth plastic body of the print cartridge near the orifice plate. Even if the ink is properly deposited in the trench, it is stored there in a pool that becomes tacky and susceptible to collecting fibers that cause the ink streaking problem mentioned above.

Sometimes, the service station wiper does not properly engage the print cartridge to deposit the residual ink in the trench. Also, the portion of the cartridge that is wiped, including the trench, is usually very close to parts of the carriage (datum features) that secure the cartridge in a precise position relative to the carriage for accurate printing. As a result, some of the ink is inadvertently transferred from the improperly engaged wiper to these carriage parts (or to other parts of the cartridge). The residual ink on these carriage parts builds up over time. Although such buildup is gradual, the residue on the carriage is not removed with each cartridge replacement so, eventually, it can accumulate to an amount sufficient to cause problems, such as ink streaking. Additionally, the residual ink on the carriage may spread to and interfere with other printer components that may contact the carriage.

The present invention is directed to handling residual ink in a way that avoids the above noted problems. In one preferred embodiment of the invention, an ink-jet print cartridge is equipped with an ink-receptive member such as an absorbent pad. The pad is located so that a service station wiper will move the residual ink from the orifice plate and to the pad.

The pad absorbs the ink. In essence, the ink is sequestered on the cartridge, in the pad. Preferably, the pad is quite porous so that the ink is drawn into the absorbent pad so that the volatile components of the ink quickly evaporate to reduce the likelihood of developing a tacky area over the pad.

Moreover, the porosity of the pad means that, as compared to a solid surface, the exposed exterior surface of the pad is greatly reduced, thereby reducing the amount of ink that can be carried on that surface. As a result, the exterior surface of the pad will have a correspondingly reduced tacky area to which fibers may stick. Even if a tacky area does develop, the reduced area of the exposed surface (hence, the reduced amount of ink for holding fibers) means that any fibers that are temporarily held by the tacky area of the pad will more readily wiped away, or be free to fall off (and not cause ink streaking) as soon as the area dries.

The ink-receptive material may be mounted to the cartridge body in any of a number of ways. In one preferred embodiment, the material is located so that a service station wiper will immediately engage the material after wiping the orifice plate. Thus, the residual ink is moved onto the ink-receptive material (and off the wiper) before the wiper moves into contact with a carriage part.

In another preferred embodiment, the cartridge body is shaped to provide a scraper for scraping the residual ink from the passing wiper. The scraper is configured and located so that the ink scraped from the wiper is deposited on the absorbent pad.

Other advantages and features of the present invention will become clear upon study of the following portion of this specification and the drawings.

DETAILED DESCRIPTION OF PREFERRED EMBODIMENTS

Figure 1:
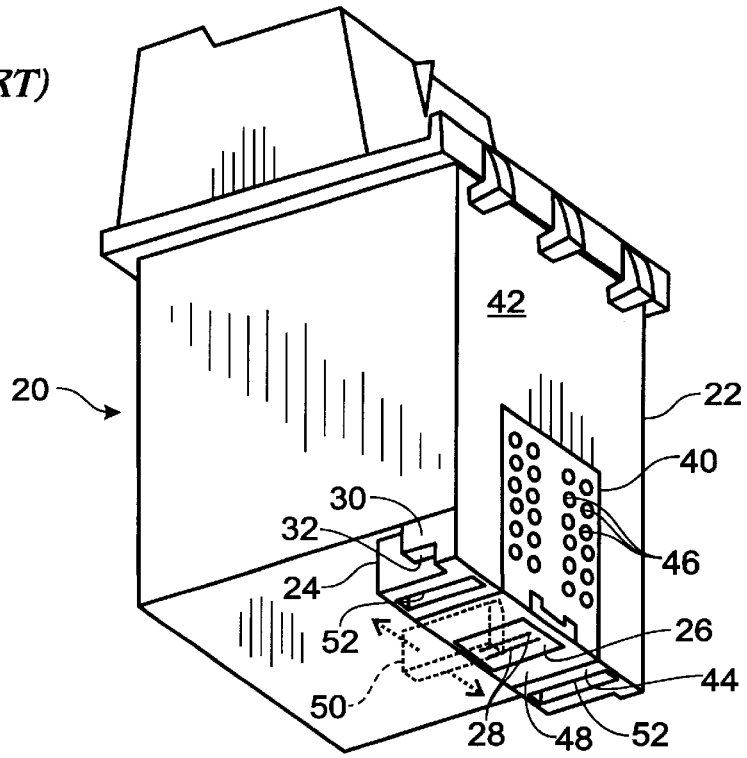
Fig. 1 (PRIOR ART)
FIG. 1 is a perspective view of a prior art ink-jet print cartridge showing the underside of the cartridge.

The prior art cartridge 20 shown in FIG. 1 includes a plastic body 22 that comprises a reservoir for containing liquid ink. The cartridge body 22 is shaped to have a downwardly extending snout 24. A print head is attached to the underside of the snout 24. The exposed portion of the print head is the exterior surface of an orifice plate 26 that includes minute orifices 28 (in this instance two rows of orifices) from which are ejected ink droplets onto printing medium that is advanced through the printer and very near the orifice plate.

Figure 3:
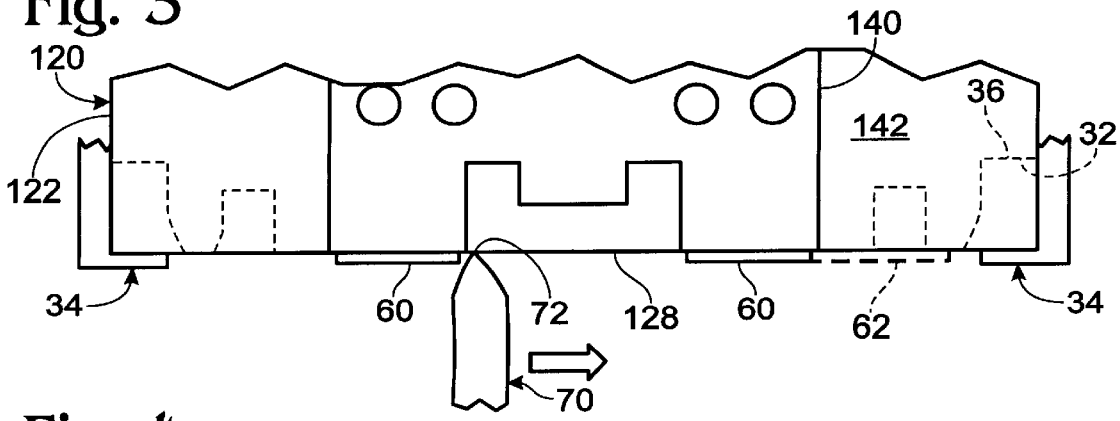
FIGS. 3–5 illustrate sequences for sequestering residual ink on an ink-jet print cartridge in accordance one preferred approach to the invention.

At the sides of the cartridge body 22, near the snout 24, there are formed features, such as shown by the "L" shaped feature 30 in FIG. 1. These features provide on the cartridge body datum or reference surfaces 32 that engage corresponding features in a carriage that carries the cartridge in the printer. FIG. 3 shows a portion of one such carriage feature 34 (which can be referred to as a datum hook) that has a surface 36 that engages the datum surface 32 of a cartridge that is carried by the carriage. Empty cartridges are removed from the printer carriage and replaced.

The greatest or most reliable printing accuracy occurs where at least some of the engaging registration surfaces cartridge body and carriage are located as closely as practical to the orifices through which the droplets are expelled. In the past, however, the proximity of the carriage components (such as datum hook 34) to the orifice plate 26 resulted in undesirable contact between at least some of the residual ink that has migrated from the orifice plate to the carriage components, as mentioned above.

The illustration of FIG. 1 also shows a thin circuit 40 that is attached to the body 22 of the cartridge 20, partly on one side 42 of the cartridge. The circuit, which is flexible before attachment, continuously extends from the side 42 across most of the underside 44 of the snout 24 next to, but not covering, the orifice plate 26. The circuit 40 may be a thin polyimide material that carries conductive traces. The traces connect at one end to contact pads in the print head that are near the long edges of the orifice plate 26. The other ends of the traces terminate in contact pads 46 on the circuit, which pads mate with corresponding pads on the carriage. In short, the circuit 40 carries the control signals from the printer microprocessor to the individual components in the print head (such as thin film resistors) that produce the ink droplet ejection through the orifices 28 of the orifice plate.

As noted earlier, ink-jet printers often include mechanisms for periodic servicing of the cartridges. These mechanisms are often referred to as service stations that, among other things, periodically wipe residual ink from the outer surface of the orifice plate 26. FIG. 1 shows in dotted lines a wiper component 50 of a service station. During a servicing operation, the resilient wiper 50 is moved into contact with the underside 44 of the snout and wiped across the orifice plate 26. Alternatively, the cartridge may be moved relative to a stationary wiper to achieve the same wiping result.

FIG. 1 also depicts the above noted approach to storing the residual ink in trenches formed in the pen body. Shown there are two trenches 52, one trench on each side of the circuit 40 and recessed into the underside 44 of the snout 24. Ink that is wiped from the orifice plate 26 is deposited in a trench 52 after the resilient wiper 50 is moved from the plate 26, along the adjacent portion 48 of the circuit 40 and across the opening of the trench 52.

In most instances, the prior approach to residual ink removal works fine. Nonetheless, the above-discussed problems with residual ink movement and ink streaking may arise. The present invention addresses these problems and provides an ink-jet cartridge that is in many respects identical to the just described prior art cartridge. As a result, this description will not repeat the detail relating to preferred embodiment components that substantially match those just described relative to the prior art cartridge 22 (such as the circuit 40, body 22, etc.).

Figure 2:
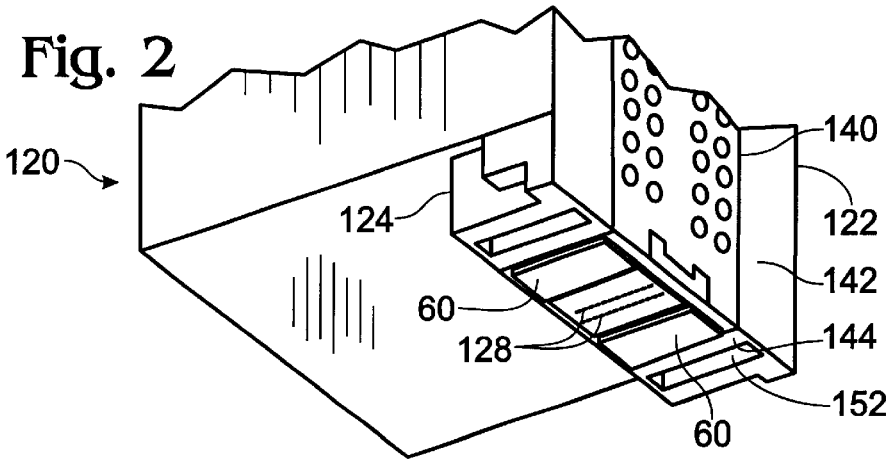
FIG. 2 is a partial perspective view of one preferred embodiment of a print cartridge adapted to sequester residual ink in accordance with the present invention.

One preferred embodiment of the present invention is shown in FIG. 2, which depicts a cartridge 120 having a body 122 generally conforming to the body 22 of the FIG. 1 cartridge. A thin circuit 140 (like circuit 40 of the FIG. 1 cartridge) is attached to one side 142 of the body 122 and extends across the underside 144 of the snout 124 of the cartridge.

As was the case with the FIG. 1 cartridge, portions of the circuit 140 extend on each long side of the orifice plate 128 that is mounted to the snout underside 144. In this embodiment, however, such portions of the circuit are covered with ink-receptive material, such as shown as absorbent pads 60. These pads 60 are fastened to the cartridge to sequester residual ink on the cartridge 120. In short, the residual ink on the orifice plate 128 is wiped across and held by the pads 60.

More particularly, one embodiment of the pads includes a thin (less than 1 mm) sheet of porous polyethersulfone (PES) that is bonded to the cartridge body 122 (in this case to the circuit 140 that is attached to the body) so that an edge of a pad 60 substantially abuts a long edge of the orifice plate 128. Other porous material may be used as an alternative to PES. For example, Nylon 6,6 will also suffice. Yet another alternative for the material that is used as a pad is a microporous polyolefin film that is impregnated with desiccants such as silica or calcium carbonate particles that facilitate drying of the residual ink that is wiped onto the pad.

This embodiment contemplates use with a service station that wipes the orifice plate in two opposite directions. As a result, the ink-receptive material is in two parts: one pad 60 on opposite sides of the orifice plate 128. It is also contemplated that a single pad on one side of the orifice plate will suffice in instances where the service station wiper moves in only one direction.

As shown in FIG. 2, the pads 60 are sized to fit between the orifice plate 128 and an adjacent trench 152 (generally matching the above-described trench 52) formed in the snout 124. In another embodiment, however, no trenches are provided, and the pads 60 are sized to extend (see dashed lines 62 in FIG. 3) over substantially the entire area of the snout underside 144, except for the orifice plate 128.

As shown in FIG. 2, the outer surface of the pads 60 are in a plane that is raised somewhat (i.e., raised but extending downwardly in FIG. 2) relative to the plane of the outer surface of the orifice plate 128. It is also contemplated that the outer, flat surfaces of the pads 60 could be flush with or even recessed relative to that of the orifice plate.

Figure 4:
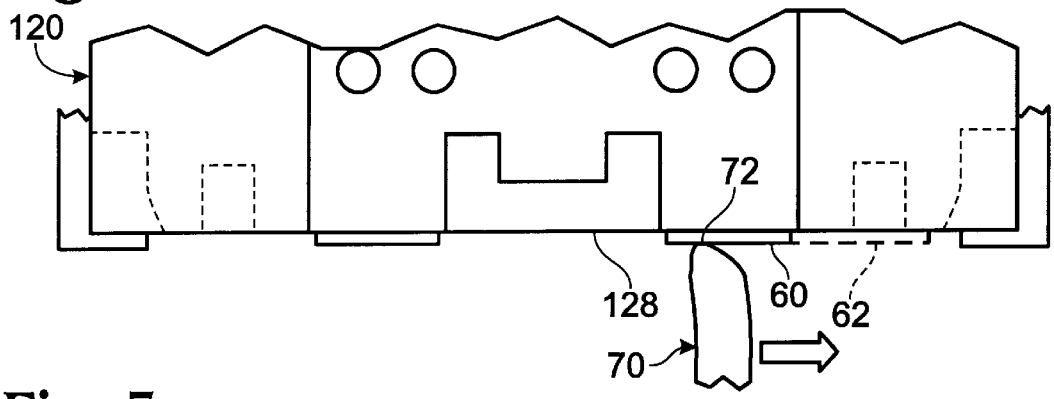
Figure 5:
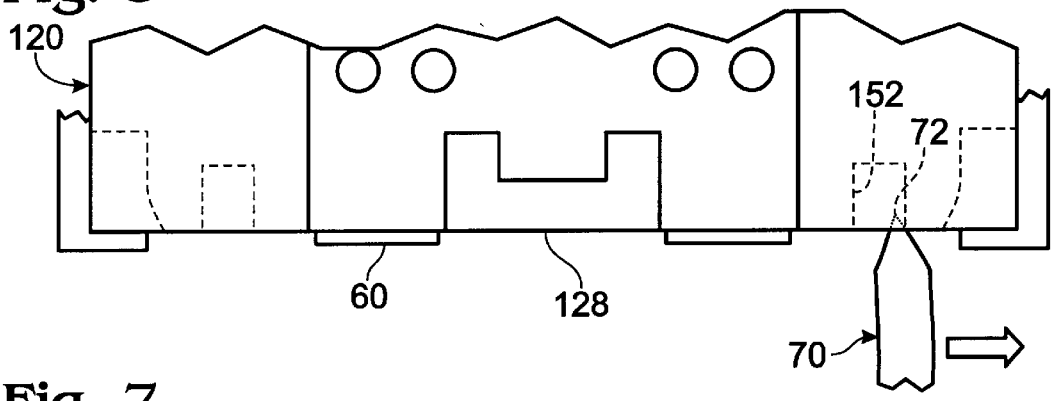

The series of FIGS. 3–5 illustrate the removal of residual ink from an orifice plate in accordance with the present invention. FIG. 3 shows in elevation view the cartridge 120 of FIG. 2 facing the front side 142 of the body 122. The cartridge 120 is mounted to a carriage with the carriage datum hooks 34 engaging the cartridge as described above. The cartridge is shown in the vicinity of a service station that includes a resilient wiper 70, formed of material such as EPDM rubber.

The wiper 70 and cartridge 120 are moved into contact with one another as the cartridge is moved into and/or out of the service station. The wiper may be carried on a sled or other mechanism that is moves the wiper, as by camming action, into the path of the cartridge. The outer tip 72 of the wiper presses against the edge of the orifice plate 128 just inside one of the pads 60 (the left pad in FIG. 3) and is thereafter guided across the orifice plate 128 (left to right in FIG. 3) to wipe from the plate any residual ink, fibers, or other debris that may be there. The wiper 70 is depicted here as a resilient member, but it need not be to carry out this wiping action in accordance with the present invention.

After the wiper tip 72 traverses the orifice plate 128, it encounters the edge of the absorbent pad 60 (here, the right pad in FIG. 4). The wiper tip 72 thus wipes across the outer surface of the absorbent pad so that the residual ink moved by the wiper from the orifice plate is wiped or spread across the pad. Thus, if the wiper tip 72 were to continue moving in the same direction (left to right) to contact the proximate carriage datum hook 34 (or any other printer part for that matter), it will have essentially wiped itself clean before such contact, thereby avoiding the undesired spreading of residual ink to, printer parts other than the cartridge 120.

The residual ink that is spread onto the absorbent pad 60 is sequestered there until the cartridge is replaced. Moreover, the absorbent characteristics of the pads 60 draw the ink from the outer surface of the pad, which permits rapid drying of any ink components remaining on the surface. Thus, any fibers that may have been temporarily held to the surface of the pad 60 by the wet ink are, as a result of the absorbence and drying, free to drop off and not cause fiber-tracking problems.

FIG. 5 shows that, in the event a trench 152 is employed (instead of the extended pad 62) the tip 72 of the wiper will be scraped in the trench opening as the wiper is moved across the trench. As noted, however, at this juncture, the wiper will have already been wiped clean of ink by spreading the ink across the absorbent-material pad 60. Thus, the trench provides some scraping action, but does not accumulate any significant amounts of liquid ink as occurred with prior art devices.

Although only one wiping direction is depicted in FIGS. 3–5, it is contemplated that the wiper 70 could also be wiped in the direction opposite to or perpendicular to the direction shown in the figures.

It will be appreciated that the ink-receptive material applied to the body of the cartridge may be embodied in material other than the absorbent pads just described. For instance, in another embodiment of the invention, the area of the cartridge next to the orifice plate 182 is coated with a very thin coating comprising a latex and/or crosslinked water soluble polymeric binder,(10–50 % by weight) and silica and/or alumina of a sol-gel precipitated or fumed absorbent filler that is applied by any of a variety of methods such as, spraying, to form a coating that is then dried and cured. Also, such a coating that includes a silica and/or an alumina filler will suffice. Coatings that use hydrogels are also suitable Moreover, a layer of absorbent material (such as, for example, a fine-mesh nylon loop material) may be attached to the cartridge and covered with another, protective layer (for example, a perforated film of polyimide such as DuPont's Kapton material) that would, as compared to this type of absorbent material, be more compatible with the wiping operation, to thus protect the absorbent material from damage by the wiper. The absorbent layer and perforated or porous protection layer is attached to the underside 144 of the snout, as appears at 60 in FIG. 2. This material can be extended as shown at 62 in FIG. 3. The mechanism for attaching the absorbent and protective layer may be a pressure-sensitive adhesive layer underlying the absorbent layer.

Figure 6:
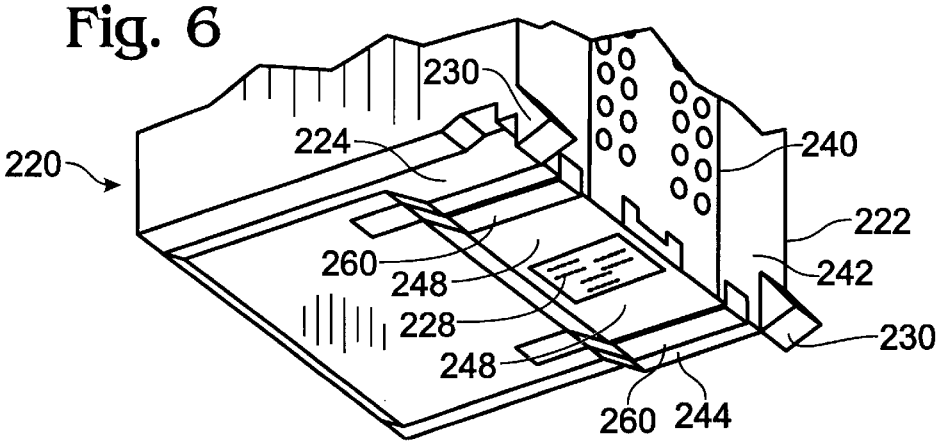
FIG. 6 is a partial perspective view of another preferred embodiment of a print cartridge adapted to sequester residual ink in accordance with the present invention.

FIG. 6 depicts another preferred embodiment of the present invention, which is made part of a cartridge 220 that has a slightly different shape than those described above. The principles of the invention apply, nonetheless.

The cartridge 220 of the FIG. 6 embodiment includes a body 222 generally conforming to the body 22 of the FIG. 1 cartridge. A thin circuit 240 (like that 40 of the FIG. 1 cartridge) is attached to one side 242 of the body 222 and extends across the underside 244 of the snout 224 of the cartridge.

As was the case in the FIG. 1 cartridge, portions 248 of the circuit 240 extend on each long side of an orifice plate 228 that is mounted to the snout underside 244. In this embodiment, absorbent pads 260 are fit into correspondingly shaped cavities in the cartridge body on either side of the circuit portions 248. The pads 260 are thus narrower (in the direction of wiper movement) than the foregoing pads 60, but the body cavities (hence, pad size) are dimensioned so that the volume of absorbent material available for sequestering the residual ink is adequate to absorb the expected amount of residual ink for a given cartridge size, print head characteristics, etc.

As before, the outer surface of the pads 260 may be in the same plane as that of the orifice plate 228, raised (as is depicted in FIG. 6), or slightly recessed relative to the plate. The pads are preferably a sintered ultra-high molecular weight, high-density polyethylene having a 15$\mu$ to 40$\mu$ pore size and a 25 % to 55 % pore volume. For the pad material discussed above, a pore volume of greater than 35% is preferred. Such material may be pre-molded or cut from stock and press fit into a cavity, or molded (sintered) within the cavity. Alternatively, the pads 260 may be bonded to the cavity walls, heat-staked, or attached by any of a variety of other ways.

Other sintered materials that may be suitable for the absorbent pad are polyethersulfone (PES), Nylon 6, and polytetrafluoroethylene (PTFE). Also, composite of polyester and polyethylene fibers may be used.

The above noted range of pore sizes provides a sufficient absorption rate for the residual ink. One could, however, select material having pore sizes outside that range and thus accept a different absorption rate while still enjoying the overall benefits of the present invention. Similarly, the pore volume may be selected outside of the preferred range mentioned above and the amount of absorbent material changed to arrive at an adequate capacity for absorbing residual ink in accordance with the present invention.

As was the case with the FIG. 2 pads 60, the residual ink on the orifice plate 228 is wiped across and held by the pads 260 as was described in connection with FIGS. 3–5.

Figure 7:
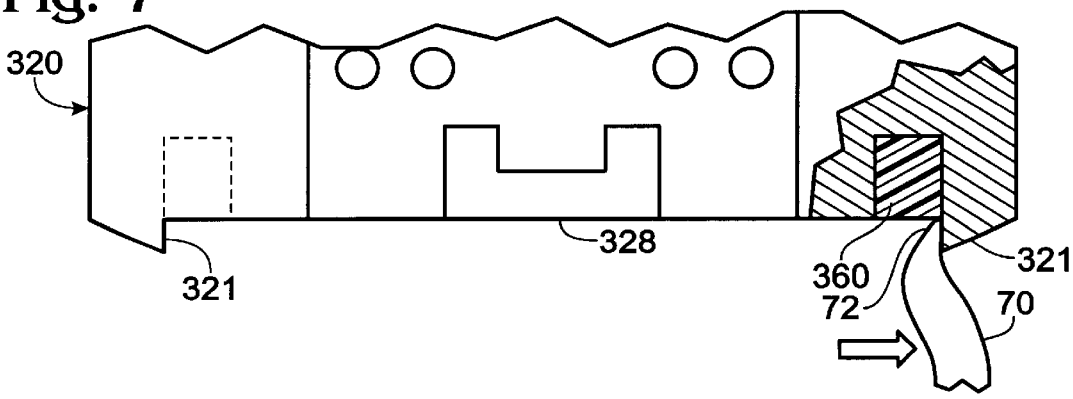
FIG. 7 is a partial side view of another preferred embodiment of the present invention.

The diagram of FIG. 7 depicts another preferred embodiment, which is essentially a modification of the embodiment described with respect to FIG. 6. In this embodiment, the body 320 of the cartridge is provided with scrapers 321 that protrude from the cartridge body into the path of the wiper 70. Each scraper extends alongside a cavity in which is carried an absorbent pad 360. The pad material and location matches the pad 260 described in the embodiment of FIG. 6.

Each scraper 321 is slightly wider than the wiper 70 (as measured in the direction normal to the plane of FIG. 7) and is located so that it will scrape across the tip 72 of the wiper just after the wiper wipes across the surface of the pad 360. The inside of the scraper (that is, the side facing the center of the orifice plate 328) is essentially an extension of a wall of the cavity that holds the pad 360. As a result, residual ink that is scraped from the wiper 70 by the scraper 321 is deposited at the junction of the scraper and pad 360 so that the ink is absorbed into the pad.

It will be appreciated that the just described embodiment ensures complete sequestering of residual ink in the pad 360 even though the pad is relatively narrow (and thus has little surface area exposed to the wiper tip). Also, there is no need to slow the speed with which the wiper 70 moves relative to the print cartridge to ensure the ink is wiped into the narrow pad because the ink scraped from the wiper remains in contact with the pad for complete absorption after the wiper passes.

While the present invention has been described in terms of preferred embodiments, it will be appreciated by one of ordinary skill that the spirit and scope of the invention is not limited to those embodiments, but extend to the various modifications and equivalents as defined in the appended claims. For example, it is also contemplated that absorbent pads could be located on the above described carriage features, thereby to ensure that any residual ink that is brought into contact with the carriage will be absorbed and dried on the carriage-mounted pad.

What is claimed is:

1. A print cartridge, comprising:

a body, an orifice plate connected to the body, the orifice plate having orifices through which ink droplets may be ejected, wherein the orifice plate has an outer surface that resides in a first plane; and an absorbent pad that is impregnated with a desiccant and attached to the body adjacent to the orifice plate, the pad having a flat outer surface that is raised relative to the outer surface of the orifice plate.

2. The cartridge of claim 1 wherein the absorbent pad is covered with a porous filing of protective material.

3. The cartridge of claim 2 wherein the absorbent pad is formed of a material that is different from the protective material.

4. The cartridge of claim 1 wherein the absorbent pad is comprised of porous polyethylene.

5. A servicing system for an ink-jet print cartridge, comprising;

an ink-jet print cartridge having a body;

an orifice plate connected to the body and having orifices formed therein to permit the ejection of ink droplets through the orifices; and a coating of ink-receptive material applied to the body of the cartridge adjacent to the orifice plate.

6. The system of claim 5 wherein the coating of ink-receptive material comprises a coating of a binder and sol-gel mixture.

7. The system of claim 5 including a scraper mounted to the body to protrude from the body, the scraper being located adjacent to the ink-receptive material.

8. A method of handing waste ink that is on an orifice plate of an ink-jet print cartridge, comprising the steps of:

providing a thin, flat layer of ink-receptive material on an outer surface of the cartridge adjacent to the orifice plate;

spreading the ink onto ink-receptive material; and drying the ink in the ink-receptive material.

9. The method of claim 8 including the step of providing a scraper on the cartridge, the scraper being adjacent to the ink-receptive material.

10. The method of claim 8 including the step of configuring the cartridge to be removed from the ink-jet printer for replacement when the cartridge is empty, thereby removing from the printer the waste ink that is in the ink-receptive material.

11. A print cartridge, comprising:

a body;

an orifice plate connected to the body, the orifice plate having an outer surface with orifices through which ink droplets may be ejected, wherein the orifice plate outer surface resides in a first plane;

an absorbent pad attached to the body adjacent to the orifice plate; and a scraper on the body that protrudes from the body and from the first plane.

12. The cartridge of claim 11 wherein the pad is located adjacent to the protruding scraper.

13. A print cartridge comprising:

a body;

an orifice plate connected to the body, the orifice plate having an outer surface with orifices through which ink droplets may be ejected, wherein the orifice plate outer surface resides in a first plane;

means for collecting residual ink at a location adjacent to the orifice plate; and a scraper on the body that protrudes from the body and from the first plane.

14. The cartridge of claim 13 wherein the means for collecting residual ink includes an absorbent pad.

* * * * *

UNITED STATES PATENT AND TRADEMARK OFFICE

CERTIFICATE OF CORRECTION

PATENT NO. : 6,454,388 B1
DATED : September 24, 2002
INVENTOR(S) : Bretl et al.

It is certified that error appears in the above-identified patent and that said Letters Patent is hereby corrected as shown below:

Column 7,
Line 58, delete “filing” and insert therefor -- film --.

Column 8,
Line 15, after “claim 5”, insert -- also --.

Signed and Sealed this

Thirtieth Day of December, 2003

JAMES E. ROGAN
*Director of the United States Patent and Trademark Office*